US012163232B2

(12) United States Patent
Kokufu et al.

(10) Patent No.: US 12,163,232 B2
(45) Date of Patent: Dec. 10, 2024

(54) TREATMENT AGENT FOR CHROMIUM-FREE INSULATING COATING FORMATION, INSULATION-COATED GRAIN-ORIENTED ELECTRICAL STEEL SHEET, AND METHOD FOR MANUFACTURING THE SAME

(71) Applicant: JFE STEEL CORPORATION, Tokyo (JP)

(72) Inventors: Karin Kokufu, Tokyo (JP); Takashi Terashima, Tokyo (JP); Toshito Takamiya, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 790 days.

(21) Appl. No.: 17/280,253

(22) PCT Filed: Sep. 2, 2019

(86) PCT No.: PCT/JP2019/034323
§ 371 (c)(1),
(2) Date: Mar. 26, 2021

(87) PCT Pub. No.: WO2020/066469
PCT Pub. Date: Apr. 2, 2020

(65) Prior Publication Data

US 2022/0049359 A1 Feb. 17, 2022

(30) Foreign Application Priority Data

Sep. 28, 2018 (JP) ..... 2018-184936

(51) Int. Cl.
*C23C 22/07* (2006.01)
*C23C 22/17* (2006.01)
(Continued)

(52) U.S. Cl.
CPC ..... *C23C 22/22* (2013.01); *C23C 22/17* (2013.01); *C23C 22/82* (2013.01)

(58) Field of Classification Search
None
See application file for complete search history.

(56) References Cited

U.S. PATENT DOCUMENTS

2017/0137633 A1* 5/2017 Terashima ..... C23C 30/00
2018/0355188 A1 12/2018 Zhang et al.

FOREIGN PATENT DOCUMENTS

CN 107190252 B 4/2018
EP 2182091 A1 5/2010
(Continued)

OTHER PUBLICATIONS

Aug. 10, 2022 Office Action issued in Chinese Patent Application No. 201980063515.7.
(Continued)

*Primary Examiner* — Lois L Zheng
(74) *Attorney, Agent, or Firm* — Oliff PLC

(57) ABSTRACT

A treatment agent for chromium-free insulating coating formation suitable for forming an insulating coating on a surface of a grain-oriented electrical steel sheet. The treatment agent includes components (A), (B), (C), and (D). The component (B) is contained in an amount of 50 to 150 parts by mass on a $SiO_2$ solid basis, and the component (C) is contained in an amount of 5.0 parts by mass or more on an elemental metal basis, the amounts being based on 100 parts by mass, on a solid basis, of the component (A). The component (D) is contained in an amount that a molar ratio of $M^{2+}$ and $M^{3+}$, each being a metal element in the treatment agent for chromium-free insulating coating formation, to a phosphorus element P satisfies a specified relationship, and
(Continued)

the treatment agent for chromium-free insulating coating formation has a pH of less than 4.5.

20 Claims, 1 Drawing Sheet

(51) Int. Cl.

| | |
|---|---|
| ***C23C 22/22*** | (2006.01) |
| ***C23C 22/82*** | (2006.01) |
| *C23C 22/00* | (2006.01) |

(56) References Cited

FOREIGN PATENT DOCUMENTS

| | | | |
|---|---|---|---|
| EP | 3135793 | A1 | 3/2017 |
| JP | S48-39338 | A | 6/1973 |
| JP | S50-79442 | A | 6/1975 |
| JP | S54-143737 | A | 11/1979 |
| JP | 2000-169972 | A | 6/2000 |
| JP | 2000-169973 | A | 6/2000 |
| JP | 2000-178760 | A | 6/2000 |
| JP | 2001-107261 | A | 4/2001 |
| JP | 2005-240131 | A | 9/2005 |
| RU | 2431697 | C1 | 10/2011 |
| RU | 2656433 | C2 | 6/2018 |

OTHER PUBLICATIONS

Jun. 25, 2021 Extended European Search Report issued in European Patent Application No. 19865734.8.
Sep. 17, 2021 Office Action issued in Russian Patent Application No. 2021108118.
Apr. 22, 2023 Office Action issued in Korean Patent Application No. 10-2021-7008860.
Oct. 15, 2019 International Search Report issued in International Application No. PCT/JP2019/034323.
Feb. 11, 2023 Office Action issued in Chinese Patent Application No. 201980063515.7.

* cited by examiner

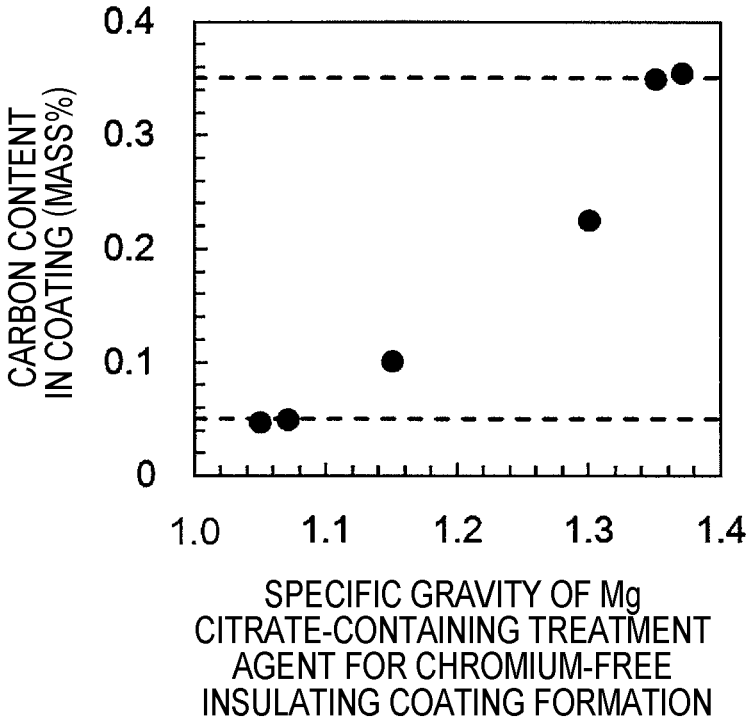
0.4
0.3
0.2
0.1
0
CARBON CONTENT IN COATING (MASS%)
1.0
1.1
1.2
1.3
1.4
SPECIFIC GRAVITY OF Mg CITRATE-CONTAINING TREATMENT AGENT FOR CHROMIUM-FREE INSULATING COATING FORMATION

TREATMENT AGENT FOR CHROMIUM-FREE INSULATING COATING FORMATION, INSULATION-COATED GRAIN-ORIENTED ELECTRICAL STEEL SHEET, AND METHOD FOR MANUFACTURING THE SAME

TECHNICAL FIELD

This application relates to a treatment agent for chromium-free insulating coating formation. The application also relates to an insulation-coated grain-oriented electrical steel sheet having on its surface an insulating coating formed by baking the treatment agent for chromium-free insulating coating formation, and a method for manufacturing the steel sheet. The application particularly relates to a treatment agent for chromium-free insulating coating formation capable of forming an insulating coating that can effectively prevent reduction in moisture absorption resistance, which has inevitably occurred in the past when a surface of a grain-oriented electrical steel sheet is coated with a chromium-free insulating coating, and provide high moisture absorption resistance comparable to those of chromium-containing insulating coatings.

BACKGROUND

A grain-oriented electrical steel sheet is a soft magnetic material used as a core material of a transformer or a generator and has a crystal structure in which the <001> orientations, which are easy magnetization axes of iron, are highly aligned with the rolling direction of the steel sheet. Such a texture is formed through secondary recrystallization, in which crystal grains with the (110)[001] orientation, i.e., the Goss orientation, are preferentially grown into giant grains during secondary recrystallization annealing in a process of manufacturing a grain-oriented electrical steel sheet.

In general, a grain-oriented electrical steel sheet is provided on its surface with a coating for imparting insulation properties, workability, antirust properties, and the like. The surface coating includes an underlying coating formed during final annealing and composed mainly of forsterite and a phosphate-based top coating formed on the underlying coating.

The coating is formed at high temperature and moreover has a low coefficient of thermal expansion. Thus, when the temperature is reduced to room temperature, a tension is imparted to the steel sheet due to a difference in coefficient of thermal expansion between the steel sheet and the coating, and iron loss is advantageously reduced. Thus, the coating is desired to impart as high a tension as possible to the steel sheet.

To satisfy such a desire, various coatings have been proposed in the related art. For example, Patent Literature 1 has proposed a coating composed mainly of magnesium phosphate, colloidal silica, and chromic anhydride, and Patent Literature 2 has proposed a coating composed mainly of aluminum phosphate, colloidal silica, and chromic anhydride.

There has recently been an increased interest in environmental conservation. Accordingly, there has been an increased demand for products containing no toxic substances, such as chromium and lead, and it has been desired to develop chromium-free coatings (coatings containing no chromium) also for grain-oriented electrical steel sheets. However, such chromium-free coatings have been impossible to realize because problems such as significant reduction in moisture absorption resistance and insufficient tension impartment have arisen.

As a method for solving the above problems, Patent Literature 3 has proposed a method for forming a coating by using a treatment liquid including colloidal silica, aluminum phosphate, boric acid, and sulfate. This improved moisture absorption resistance and the iron loss-reducing effect due to tension impartment, but the effect of this method alone in improving iron loss and moisture absorption resistance was less than sufficient, as compared to the case where a coating containing chromium was formed.

To solve this, for example, an attempt was made to increase the amount of colloidal silica in a treatment liquid. This solved the problem of insufficient tension impartment and increased the iron loss-reducing effect but, on the contrary, reduced moisture absorption resistance. An attempt was also made to increase the amount of sulfate added. In this case, moisture absorption resistance was improved, but the iron loss-reducing effect was not sufficient due to insufficient tension impartment. In both cases, the two properties, i.e., moisture absorption resistance and the iron loss-reducing effect due to tension impartment, could not simultaneously be satisfied.

In addition to these methods, methods for forming a chromium-free coating have been disclosed. For example, Patent Literature 4 has disclosed a method in which a boron compound is added in place of a chromium compound, and Patent Literature 5 has disclosed a method in which an oxide colloid-like material is added. However, none of these techniques increase moisture absorption resistance and the iron loss-reducing effect due to tension impartment to the same levels as when a coating containing chromium is formed, and thus, these techniques are not perfect solutions. Patent Literature 6 has disclosed a technique in which at least one of organic acid salts of Ca, Mn, Fe, Mg, Zn, Co, Ni, Cu, B, and Al is contained in a treatment agent in order to provide a coating with improved corrosion resistance and annealing resistance. However, the technique in Patent Literature 6 unfortunately causes cracking and blistering of a coating, thus resulting in a low coating tension, and does not increase moisture absorption resistance and corrosion resistance to the same levels as when a coating containing chromium is formed.

CITATION LIST

Patent Literature

PTL 1: Japanese Unexamined Patent Application Publication No. 50-79442

PTL 2: Japanese Unexamined Patent Application Publication No. 48-39338

PTL 3: Japanese Unexamined Patent Application Publication No. 54-143737

PTL 4: Japanese Unexamined Patent Application Publication No. 2000-169973

PTL 5: Japanese Unexamined Patent Application Publication No. 2000-169972

PTL 6: Japanese Unexamined Patent Application Publication No. 2000-178760

SUMMARY

Technical Problem

The disclosed embodiments have been made in view of the above circumstances, and an object of the disclosed embodiments is to provide a treatment agent for chromium-free insulating coating formation that can form an insulating coating having a high coating tension, high moisture absorption resistance, and high corrosion resistance. Another object of the disclosed embodiments is to provide an insulation-coated grain-oriented electrical steel sheet including a chromium-free insulating coating having a high coating tension, high moisture absorption resistance, and high corrosion resistance, and a method for manufacturing the steel sheet.

Solution to Problem

To solve the problems described above, the present inventors have conducted intensive investigations and studies to provide a chromium-free insulating coating with desired moisture absorption resistance, desired corrosion resistance, and a high coating tension. As a result, it has been discovered that the reason why the coating tension, moisture absorption resistance, and corrosion resistance are poor when the technique in Patent Literature 6 is used is that the content of an organic acid salt of Ca, Mn, Fe, Mg, Zn, Co, Ni, Cu, B, or Al is insufficient. It has also been found that as disclosed in Patent Literature 6, when the content of an organic acid salt is increased, the organic acid salt precipitates on a surface of an insulating coating to become foreign matter, which reduces the adhesiveness and coating tension of the insulating coating or causes the insulating coating to have a lusterless appearance. Thus, the present inventors have conducted intensive studies to further increase the content of an organic acid salt while avoiding precipitation of foreign matter, and found that the content of an organic acid salt can be increased by adding phosphoric acid ($H_3PO_4$) into a treatment agent for insulating coating formation to adjust the molar ratio of $M^{2+}$ and $M^{3+}$, each being a metal element in the treatment agent, to a phosphorus element P, i.e., $(M^{2+}+1.5\times M^{3+})/P$, and the pH to be not more than certain values, thereby accomplishing the disclosed embodiments.

Thus, the gist of the disclosed embodiments is as follows.

[1] A treatment agent for chromium-free insulating coating formation that is used for forming an insulating coating on a surface of a grain-oriented electrical steel sheet, the treatment agent including:

a component (A): at least one selected from phosphates of Mg, Ca, Ba, Sr, Zn, Al, and Mn;

a component (B): colloidal silica;

a component (C): at least one selected from organic acid salts of Mg, Ca, Ba, Sr, Zn, Al, Mn, Fe, Ni, Cu, and Co; and a component (D): phosphoric acid, wherein the component (B) is contained in an amount of 50 to 150 parts by mass on a $SiO_2$ solid basis, and the component (C) is contained in an amount of 5.0 parts by mass or more on an elemental metal basis, the amounts being based on 100 parts by mass, on a solid basis, of the component (A), and the component (D) is contained in such an amount that a molar ratio of $M^{2+}$ and $M^{3+}$, each being a metal element in the treatment agent for chromium-free insulating coating formation, to a phosphorus element P satisfies $0.50<(M^{2+}+1.5\times M^{3+})/\leq P$ 1.20 (where $M^{2+}$ is at least one selected from Mg, Ca, Ba, Sr, Zn, Mn, Ni, Cu, and Co, and $M^{3+}$ is at least one selected from Al and Fe) and that the treatment agent for chromium-free insulating coating formation has a pH of less than 4.5.

[2] The treatment agent for chromium-free insulating coating formation according to [1], wherein the component (C) includes at least one selected from carboxylates of Mg, Ca, Ba, Sr, Zn, Al, Mn, Fe, Ni, Cu, and Co.

[3] The treatment agent for chromium-free insulating coating formation according to [1] or [2], wherein the component (C) includes at least one selected from formates, oxalates, citrates, tartrates, lactates, malonates, succinates, salicylates, acetates, and gluconates of Mg, Ca, Ba, Sr, Zn, Al, Mn, Fe, Ni, Cu, and Co.

[4] The treatment agent for chromium-free insulating coating formation according to any one of [1] to [3], wherein the treatment agent has a specific gravity of 1.07 to 1.35.

[5] An insulation-coated grain-oriented electrical steel sheet including a grain-oriented electrical steel sheet, and an insulating coating formed by baking the treatment agent for chromium-free insulating coating formation according to any one of [1] to [4], the insulating coating being disposed on a surface of the grain-oriented electrical steel sheet.

[6] The insulation-coated grain-oriented electrical steel sheet according to [5], wherein a carbon content in a coating including the insulating coating is 0.050 to 0.350 mass %.

[7] A method for manufacturing an insulation-coated grain-oriented electrical steel sheet, including applying the treatment agent for chromium-free insulating coating formation according to any one of [1] to [4] to a surface of a grain-oriented electrical steel sheet, and baking the treatment agent.

Advantageous Effects

According to the disclosed embodiments, a treatment agent for chromium-free insulating coating formation that can form an insulating coating having a high coating tension, high moisture absorption resistance, and high corrosion resistance can be provided.

Hereinafter, the treatment agent for chromium-free insulating coating formation is also referred to simply as the "treatment agent".

BRIEF DESCRIPTION OF THE DRAWINGS

FIG. 1 is an example of a graph showing the relationship between the specific gravities of treatment agents and the carbon contents in coatings.

DETAILED DESCRIPTION

Hereinafter, the experimental results forming the basis of the disclosed embodiments will be described.

A treatment agent was first prepared in the following manner.

First, 100 parts by mass, on a solid basis, of monomagnesium phosphate, 117 parts by mass, on a $SiO_2$ solid basis, of colloidal silica, 16.7 parts by mass, on a magnesium basis, of trimagnesium dicitrate, and an aqueous orthophosphoric acid solution (specific gravity: 1.69) having a concentration of 85 mass % were added such that the molar ratio of $M^{2+}$ and $M^{3+}$, each being a metal element in a treatment agent, to a phosphorus element P, that is, $Mg^{2+}/P$, is as shown in Table 1, thereby producing treatment agents for chromium-free insulating coating formation. The treatment agents were each applied to a final-annealed grain-oriented electrical steel sheet manufactured by a known method and having a forsterite coating and a thickness of 0.23 mm such that the total coating weight per unit area on both surfaces after drying would be 8 g/m$^2$, dried at 300° C. for one minute, and then subjected to a heat treatment (850° C., two minutes, 100 vol % $N_2$ atmosphere) for simultaneously achieving flattening annealing and baking of an insulating coating.

For the insulation-coated grain-oriented electrical steel sheets thus obtained, the occurrence of precipitation of foreign matter on the insulating coating surface, the tension (coating tension) imparted to the grain-oriented electrical steel sheet, moisture absorption resistance, and corrosion resistance were examined by the following methods. For the imparted tension and the corrosion resistance, test pieces were collected, and then subjected to stress relief annealing (800° C., two hours) before being tested.

For the occurrence of precipitation of foreign matter, the insulating coating surface was visually observed and evaluated. Test pieces on which precipitation of foreign matter was observed were scored as "yes", and test pieces on which precipitation of foreign matter was not observed were scored as "no".

The tension (coating tension) imparted to the grain-oriented electrical steel sheet by the insulating coating was a tension in a rolling direction and determined as follows: an insulating coating on one surface of a test piece having a length in the rolling direction of 280 mm and a length in a direction perpendicular to the rolling direction of 30 mm was peeled and removed using an alkali, an acid, or the like with an insulating coating on the other surface masked with an adhesive tape so as not to be removed; next, a 30-mm portion at one end of the test piece was fixed, and the amount of warpage was measured using the 250-mm portion of the test piece as a measurement length; and the coating tension was calculated using the following formula (I).

$$\text{Tension [MPa] imparted to steel sheet} = \text{Young's modulus [GPa] of steel sheet} \times \text{sheet thickness [mm]} \times \text{amount of warpage [mm]} \div (\text{measurement length [mm]})^2 \times 10^3 \quad \text{Formula (I)}$$

Here, the Young's modulus of the steel sheet was assumed to be 132 GPa. Test pieces having a coating tension of 8.0 MPa or more were evaluated as being good (having a high coating tension).

The moisture absorption resistance was evaluated by conducting a phosphorus dissolution test. Three test pieces of 50 mm×50 mm were immersed and boiled in distilled water at 100° C. for five minutes, and the amount of dissolved phosphorus [μg/150 $cm^2$] was measured to evaluate the tendency of the tension coating to dissolve in water. Test pieces whose amount of dissolved P (phosphorus) was 220 [μg/150 $cm^2$] or less were evaluated as being good (having high moisture absorption resistance). The method of measuring the amount of dissolved P is not particularly limited. For example, the amount of dissolved P can be measured by quantitative analysis using ICP emission spectrometry.

For the corrosion resistance, after a test piece of 50 mm×50 mm in the form of a single steel sheet was held in an air atmosphere at a relative humidity of 50% and a temperature of 50° C. for 50 hours, the surface of the steel sheet was observed. Test pieces having no rust and very high corrosion resistance were scored as ⊙; test pieces having a rust area fraction of less than 5% and high corrosion resistance as ○; and test pieces having a rust area fraction of 5% or more as x. Test pieces scored as ⊙ and ○ were evaluated as being good (having high corrosion resistance).

Table 1 shows the results of evaluations of the occurrence of precipitation of foreign matter on the insulating coating surface, the coating tension, the amount of dissolved phosphorus, and the corrosion resistance.

TABLE 1

| Sample No. | Amount of aqueous orthophosphonc acid solution added (mL) | $Mg^{2+}/P$ | pH of treatment agent | Precipitation of foreign matter | Coating tension (MPa) | Amount of dissolved phosphorus (μg/150 $cm^2$) | Corrosion resistance | Remark |
|---|---|---|---|---|---|---|---|---|
| 1-1 | 0 | 1.30 | 4.8 | yes | 4.0 | 1400 | X | Comparative Example |
| 1-2 | 3.6 | 1.20 | 3.1 | no | 8.2 | 70 | ◎ | Example |
| 1-3 | 5.4 | 1.10 | 2.9 | no | 8.5 | 70 | ◎ | Example |

The above experimental results show that when phosphoric acid is added to adjust the molar ratio of $M^{2+}$ and $M^{3+}$, each being a metal element in the treatment agent, to a phosphorus element P, i.e., $(M^{2+}+1.5\times M^{3+})/P$, and the pH to be not more than certain values, precipitation does not occur even if an organic acid salt is contained in a large amount, and a chromium-free insulating coating having high corrosion resistance, high moisture absorption resistance, and a sufficient coating tension can be formed.

The reason why the disclosed embodiments can improve the moisture absorption resistance of the insulating coating is presumably as follows. During baking or stress relief annealing in insulating coating formation, the metal element in an organic acid salt in the treatment agent becomes free as a result of elimination of organic moieties and reacts with free phosphoric acid to form a stable phosphoric acid compound. That is, when a chromium compound of the related art is contained, Cr reacts with free phosphoric acid to form a very stable compound such as $CrPO_4$, and as with this case, the metal element in an organic acid salt reacts with phosphoric acid moieties to be stabilized in a high-temperature range during baking or stress relief annealing, thus suppressing decomposition to improve the moisture absorption resistance.

The insulating coating formed from the treatment agent according to the disclosed embodiments is less likely to undergo cracking and thus can suppress the reduction in coating tension and corrosion resistance due to cracking. The reason why the disclosed embodiments can prevent cracking of the insulating coating after baking is presumably as follows. Cracking of the insulating coating occurs in the following manner: the surface of the insulating coating during baking is semi-solidified, and in this state, $H_2O$ formed by dehydration of phosphate raises the insulating coating to cause cracking. During baking of the insulating coating, organic moieties in an organic acid salt are decomposed to generate gases such as CO and $CO_2$, and pathways for the gases serve as pathways for $H_2O$ at high temperature, thus suppressing cracking of the insulating coating.

Next, constituents related to the disclosed embodiments will be described.

[Grain-Oriented Electrical Steel Sheet]

Steel sheets of interest in the disclosed embodiments are grain-oriented electrical steel sheets. Typically, a grain-oriented electrical steel sheet is manufactured by hot rolling a silicon-containing steel slab by a known method, subjecting the resultant to one cold rolling process or a plurality of rolling processes including process annealing to a final sheet thickness, performing primary recrystallization annealing, applying an annealing separator, and then performing final annealing.

[Treatment Agent for Chromium-Free Insulating Coating Formation]

The treatment agent for chromium-free insulating coating formation according to the disclosed embodiments contains the following components (A) to (D).

[Component (A): Phosphate]

At least one selected from phosphates of Mg, Ca, Ba, Sr, Zn, Al, and Mn is used as a phosphate. Typically, one of these phosphates is used, but two or more of them may be used in combination. Suitable types of phosphates are monophosphates (biphosphates), which are readily available.

[Component (B): Colloidal Silica]

In the treatment agent according to the disclosed embodiments, the ratio between the component (A) and colloidal silica in a base liquid is important. Based on 100 parts by mass, on a solid basis, of the component (A), the amount of colloidal silica is 50 to 150 parts by mass on a $SiO_2$ solid basis. When the amount of colloidal silica is less than 50 parts by mass, the effect of reducing the coefficient of thermal expansion of an insulating coating formed is small, and the tension imparted to a steel sheet is reduced; thus, the iron loss-improving effect due to insulating coating formation cannot be produced. When the amount of colloidal silica is more than 150 parts by mass, the insulating coating tends to undergo crystallization and cracking during baking, and the corrosion resistance and adhesiveness of the insulating coating may also be degraded.

[Component (C): Organic Acid Salt]

The treatment agent according to the disclosed embodiments contains at least one organic acid salt selected from organic acid salts of Mg, Ca, Ba, Sr, Zn, Al, Mn, Fe, Ni, Cu, and Co. The organic acid salt is contained in an amount of 5.0 parts by mass or more in terms of the metal element in the organic acid salt, based on 100 parts by mass, on a solid basis, of the component (A). To provide a higher coating tension, the organic acid salt is contained, in terms of the metal element in the organic acid salt, preferably in an amount of more than 5.0 parts by mass, more preferably in an amount of 7.0 parts by mass or more, still more preferably in an amount of 10 parts by mass or more, based on 100 parts by mass, on a solid basis, of the component (A). If the content of the organic acid salt is less than 5.0 parts by mass on an elemental metal basis, stabilization of P due to the reaction between free phosphoric acid and the metal element in an insulating coating cannot be achieved, and, in addition, the insulating coating may undergo blistering or cracking, and the effect of improving moisture absorption resistance and corrosion resistance cannot be sufficiently produced. The upper limit of the content of the organic acid salt is not particularly limited. For example, the content of the organic acid salt may be, in terms of the metal element in the organic acid salt, 60 parts by mass or less or 50 parts by mass or less, based on 100 parts by mass, on a solid basis, of the component (A). The organic acid salt may not only be an organic acid salt itself but also be a reaction product, such as a product of the reaction between an organic acid salt or organic acid and a metal hydroxide. If there are no problems with the stability of the treatment agent, a free organic acid, that is, an acid component such as a carboxylic acid not reacted with a metal may be present, provided that the content of the free organic acid is preferably not more than the number of moles of the organic acid salt.

The organic acid constituting the organic acid salt is preferably a carboxylic acid, that is, an organic acid having at least one carboxy group. The carboxylic acid may have a functional group other than the carboxy group. The functional group may be, for example, a hydroxy group. Due to the presence of the organic acid salt, during baking in insulating coating formation, organic moieties in the organic acid salt are decomposed to generate gases such as CO and $CO_2$, and pathways for the gases serve as pathways for $H_2O$ at high temperature, thus suppressing cracking of the insulating coating. The organic acid salt preferably includes at least one of carboxylates of Mg, Ca, Ba, Sr, Zn, Al, Mn, Fe, Ni, Cu, and Co. Preferred examples of the carboxylates include formates, oxalates, citrates, tartrates, lactates, malonates, succinates, salicylates, acetates, and gluconates of Mg, Ca, Ba, Sr, Zn, Al, Mn, Fe, Ni, Cu, and Co. In particular, citrates, tartrates, and succinates are preferred. This is because many (two or more) carboxy groups (COOH), which are readily decomposed into $CO_2$, are included in one molecule, and many hydroxy groups (OH) and carbon atoms, which respectively serve as an ○ source and a C source of CO and $CO_2$ gases, are included in one molecule, thus effectively suppressing cracking of the insulating coating. One organic acid salt or two or more organic acid salts may be used.

[Component (D): Phosphoric Acid]

In the disclosed embodiments, phosphoric acid ($H_3PO_4$) is set to be richer than the theoretical molar ratio of the phosphoric acid and metal of the phosphate of the component (A), whereby the influence of addition of an organic acid salt on the pH of the treatment agent and an excessive increase in the molar ratio of the metal elements in the treatment agent to $P(M^{2+}+1.5\times M^{3+})/P$ are suppressed. Phosphoric acid is contained in such an amount that the molar ratio of $M^{2+}$ and $M^{3+}$, each being a metal element in the treatment agent, to a phosphorus element P satisfies $0.50<(M^{2+}+1.5\times M^{3+})/P\leq 1.20$ (where $M^{2+}$ is at least one selected from Mg, Ca, Ba, Sr, Zn, Mn, Ni, Cu, and Co, and $M^{3+}$ is at least one selected from Al and Fe) and that pH<4.5 is satisfied. More preferably, the molar ratio is in the range of $0.67\ (M^{2+}+1.5\times M^{3+})/P$. Still more preferably, the molar ratio is in the range of $(M^{2+}+1.5\times M^{3+})/P\leq 0.83$. Within this range, the coating tension can be further increased. In the disclosed embodiments, to uniformize M, which means metal elements in the treatment agent, as a divalent metal, a trivalent metal is multiplied by 1.5. When $(M^{2+}+1.5\times M^{3+})/P$ in the treatment agent is 0.50 or less, P in the insulating coating is excessive, and the amount of dissolved phosphorus is increased, resulting in degradation of moisture absorption resistance and corrosion resistance. By contrast, when $(M^{2+}+1.5\times M^{3+})/P$ is more than 1.20, it is disadvantageous in that the insulating coating tends to be crystallized, and, as a result, cracking may occur to degrade the coating tension or corrosion resistance, and also in that the pH of a solution is greatly changed by the addition of an organic acid salt, and as a result, precipitation of the organic acid salt may occur. Phosphoric acid ($H_3PO_4$) is added in such an amount that the treatment agent has a pH of less than 4.5. More preferably, the pH is less than 3.0. Within this range, the stability of the treatment agent is high, and the coating tension can be further increased. If the pH of the treatment agent is 4.5 or more, or even when pH<4.5 is satisfied, if $(M^{2+}+1.5\times M^{3+})/P\leq 1.20$ is not satisfied because of insufficient addition of phosphoric acid ($H_3PO_4$), it is disadvantageous in that precipitation of the organic acid salt or insoluble phosphate may occur.

To achieve a carbon content in a coating described below, the treatment agent according to the disclosed embodiments preferably has a specific gravity (SG) in the range of 1.07 to 1.35. When the specific gravity of the treatment agent is 1.07 or more, a coating formed from the treatment agent is less likely to undergo cracking and tends to have higher corrosion resistance. When the specific gravity of the treatment agent is 1.35 or less, the coating tension tends to be higher.

[Method for Producing Treatment Agent for Chromium-Free Insulating Coating Formation]

The treatment agent for chromium-free insulating coating formation according to the disclosed embodiments can be produced by a known method under known conditions. For example, the treatment agent can be produced by mixing the above-described components with water serving as a solvent.

The treatment agent for chromium-free insulating coating formation may be produced by mixing together the component (A): at least one selected from phosphates of Mg, Ca, Ba, Sr, Zn, Al, and Mn, the component (B): colloidal silica, the component (C): at least one selected from organic acid salts of Mg, Ca, Ba, Sr, Zn, Al, Mn, Fe, Ni, Cu, and Co, and the component (D): phosphoric acid. The components are mixed together in such a mixing ratio that the component (B) is contained in an amount of 50 to 150 parts by mass on a $SiO_2$ solid basis, and the component (C) is contained in an amount of 5.0 parts by mass or more on an elemental metal basis, the amounts being based on 100 parts by mass, on a solid basis, of the component (A), and that the component (D) is contained in such an amount that the molar ratio of $M^{2+}$ and $M^{3+}$, each being a metal element in the treatment agent for chromium-free insulating coating formation, to a phosphorus element P satisfies $0.50<(M^{2+}+1.5\times M^{3+})/P\leq 1.20$ (where $M^{2+}$ is at least one selected from Mg, Ca, Ba, Sr, Zn, Mn, Ni, Cu, and Co, and $M^{3+}$ is at least one selected from Al and Fe) and that the treatment agent for chromium-free insulating coating formation has a pH of less than 4.5.

The specific gravity of the treatment agent can be adjusted, for example, by using water as a solvent and adjusting the mixing ratio thereof.

[Method of Forming Insulating Coating]

[Method of Applying Treatment Agent for Chromium-Free Insulating Coating Formation]

The method of applying the treatment agent for chromium-free insulating coating formation according to the disclosed embodiments to a surface of a grain-oriented electrical steel sheet is not particularly limited, and a method known in the art can be used. The treatment agent is applied to at least one surface of a steel sheet.

Preferably, the treatment agent is applied to both surfaces of the steel sheet. More preferably, the treatment agent is applied such that the total coating weight per unit area on both surfaces after baking (after drying and baking, when drying described below is performed) will be 4 to 15 g/m$^2$. When the total coating weight per unit area on both surfaces is 4 g/m$^2$ or more, a decrease in interlaminar resistance is less likely to occur, and when the total coating weight per unit area on both surfaces is 15 g/m$^2$ or less, a decrease in lamination factor is less likely to occur.

[Method of Baking]

Next, the grain-oriented electrical steel sheet to which the treatment agent for chromium-free insulating coating formation according to the disclosed embodiments has been applied and which has optionally been dried is subjected to baking, thereby forming an insulating coating. To simultaneously achieve flattening annealing, the baking is preferably performed at 800° C. to 1000° C. for 10 to 300 seconds. When the baking temperature is 800° C. or higher and the baking time is 10 seconds or more, sufficient flattening is achieved to form a good shape, as a result of which, the yield rate tends to be high, and organic moieties in the organic acid salt are readily removed. When the baking temperature is 1000° C. or lower and the baking time is 300 seconds or less, degradation of magnetic properties due to creep deformation, which occurs when the effect of flattening annealing is too strong, is less likely to occur.

[Insulation-Coated Grain-Oriented Electrical Steel Sheet]

The insulation-coated grain-oriented electrical steel sheet according to the disclosed embodiments includes a grain-oriented electrical steel sheet and an insulating coating formed by baking the above treatment agent for chromium-free insulating coating formation, the insulating coating being disposed on a surface of the grain-oriented electrical steel sheet. The grain-oriented electrical steel sheet may have a forsterite coating (an underlying coating).

[Carbon Content in Coating]

The insulating coating preferably contains carbon derived from the organic acid salt in an appropriate range. The appropriate range of carbon can be set as a carbon content (C content) in a coating including the insulating coating. Here, the carbon content in a coating is a carbon content in a coating of the insulation-coated grain-oriented electrical steel sheet. When the coating is constituted only by the insulating coating, the carbon content in a coating means a carbon content in the insulating coating, and when the coating is constituted by a forsterite coating and the insulating coating, the carbon content in a coating means a carbon content in the coating constituted by the forsterite coating and the insulating coating. The carbon content in a coating is preferably 0.050 to 0.350 mass %. When the carbon content in a coating is 0.050 mass % or more, the insulating coating is less likely to undergo cracking and tends to have higher corrosion resistance. When the carbon content in a coating is 0.350 mass % or less, the coating tension tends to be higher. The carbon content in a coating can be adjusted by adjusting the specific gravity of the treatment agent, as described above. For reference, the relationship between the specific gravities of Mg citrate-containing treatment agents obtained in Example 4 described below and the carbon contents in coatings is shown in FIG. 1.

The method of measuring the carbon content in a coating is not particularly limited, and, for example, a method in accordance with JIS G 1211-3 can be used. Specifically, a sample of 2 g or more is cut out from an insulation-coated grain-oriented electrical steel sheet, and the sample is heated at 1200° C. to 1450° C. under a stream of oxygen. Carbon dioxide formed as a result of oxidization of carbon is delivered, together with oxygen, to an infrared absorbing cell, and the amount of infrared absorption is converted into the amount of carbon by using a calibration curve to determine the amount of carbon in the insulation-coated grain-oriented electrical steel sheet. Separately, a sample of the grain-oriented electrical steel sheet from which the coating has been removed is prepared, and the amount of carbon in the grain-oriented electrical steel sheet from which the coating has been removed is determined in the same manner as above. The carbon content in the coating can be determined from a difference between the amount of carbon in the insulation-coated grain-oriented electrical steel sheet and the amount of carbon in the grain-oriented electrical steel sheet from which the coating has been removed.

Alternatively, the carbon content in a coating may be determined by TEM-EDS analysis or FE-EPMA analysis of a cross section of a coating of an insulation-coated grain-oriented electrical steel sheet.

The disclosed embodiments will now be described in detail with reference to examples. It should be noted that the disclosed embodiments is not limited to the following examples.

EXAMPLES

Example 1

Treatment agents for chromium-free insulating coating formation each containing a phosphate, colloidal silica, and Mg citrate shown in Table 2 and an aqueous orthophosphoric acid solution (specific gravity: 1.69) having a concentration of 85 mass % and each adjusted to a pH of less than 4.5 and a compositional ratio shown in Table 2 were produced. The treatment agents were each applied to a final-annealed grain-oriented electrical steel sheet manufactured by a known method and having a forsterite coating and a thickness of 0.23 mm such that the total coating weight per unit area on both surfaces after drying would be 8 g/m$^2$, dried at 300° C. for one minute, and then subjected to a heat treatment (850° C., two minutes, 100 vol % $N_2$ atmosphere) for simultaneously achieving flattening annealing and baking of an insulating coating.

Samples of the insulation-coated grain-oriented electrical steel sheets thus obtained were evaluated for the tension imparted to the steel sheet (coating tension), moisture absorption resistance, and corrosion resistance by the above-described methods. For the imparted tension and the corrosion resistance, samples were collected, and then subjected to stress relief annealing (800° C., two hours) before being tested. The evaluation results are shown in Table 2.

As shown in Table 2, when a treatment agent containing colloidal silica in an amount of 50 to 150 parts by mass on a $SiO_2$ solid basis based on 100 parts by mass, on a solid basis, of a phosphate and adjusted to the ranges of the disclosed embodiments with an organic acid salt and phosphoric acid was baked, an insulating coating having good corrosion resistance, a high coating tension, and high moisture absorption resistance was obtained.

Example 2

Treatment agents for chromium-free insulating coating formation each containing Mg phosphate, colloidal silica, and an organic or inorganic acid salt shown in Table 3 and an aqueous orthophosphoric acid solution (specific gravity: 1.69) having a concentration of 85 mass % and each adjusted to a pH of less than 4.5 and a compositional ratio shown in Table 3 were produced. The treatment agents were each applied to a final-annealed grain-oriented electrical steel sheet manufactured by a known method and having a forsterite coating and a thickness of 0.23 mm such that the total coating weight per unit area on both surfaces after drying would be 8 g/m$^2$, dried at 300° C. for one minute, and then subjected to a heat treatment (850° C., two minutes, 100 vol % $N_2$ atmosphere) for simultaneously achieving flattening annealing and baking of an insulating coating.

Samples of the insulation-coated grain-oriented electrical steel sheets thus obtained were evaluated for the tension imparted to the steel sheet (coating tension), moisture absorption resistance, and corrosion resistance by the above-described methods. For the imparted tension and the corrosion resistance, samples were collected, and then subjected to stress relief annealing (800° C., two hours) before being tested. The evaluation results are shown in Table 3.

TABLE 2

| Sample No. | Phosphate (g) (on solid basis) Mg phosphate | Ca phosphate | Al phosphate | Ba phosphate | Zn phosphate | Mn phosphate | Colloidal silica (g) (on $SiO_2$ solid basis) | Mg citrate (g) (on Mg basis) | $(M^{2+} + 1.5 \times M^{3+})/P$ | Coating tension (MPa) | Amount of dissolved phosphorus (μg/150 cm$_2$) | Corrosion resistance | Remark |
|---|---|---|---|---|---|---|---|---|---|---|---|---|---|
| 2-1 | 100 | — | — | — | — | — | 45 | 10 | 0.75 | 5.0 | 110 | ○ | Comparative Example |
| 2-2 | 100 | — | — | — | — | — | 50 | | | 9.0 | 100 | ◎ | Example |
| 2-3 | 100 | — | — | — | — | — | 100 | | | 9.4 | 70 | ◎ | Example |
| 2-4 | — | 100 | — | — | — | — | 100 | | | 9.3 | 80 | ◎ | Example |
| 2-5 | — | — | 100 | — | — | — | 100 | | | 9.5 | 70 | ◎ | Example |
| 2-6 | — | — | — | 100 | — | — | 110 | | | 9.5 | 70 | ◎ | Example |
| 2-7 | — | — | — | — | 100 | — | 110 | | | 9.7 | 70 | ◎ | Example |
| 2-8 | — | — | — | — | — | 100 | 110 | | | 9.5 | 60 | ◎ | Example |
| 2-9 | 50 | — | — | 50 | — | — | 110 | | | 9.5 | 70 | ◎ | Example |
| 2-10 | — | — | 50 | — | 25 | 25 | 110 | | | 9.5 | 60 | ◎ | Example |
| 2-11 | 100 | — | — | — | — | — | 120 | | | 9.7 | 50 | ◎ | Example |
| 2-12 | 100 | — | — | — | — | — | 150 | | | 9.3 | 60 | ◎ | Example |
| 2-13 | 100 | — | — | — | — | — | 155 | | | 8.0 | 100 | X | Comparative Example |

TABLE 3

| Sample No. | Mg phosphate (g) (on solid basis) | Colloidal silica (g) (on $SiO_2$ solid basis) | Organic acid salt (g) on elementary metal basis | | | | | | | |
|---|---|---|---|---|---|---|---|---|---|---|
| | | | Mg gluconate | Ca lactate | Sr formate | Ba tartrate | Mn formate | Co salicylate | Cu succinate | Fe citrate |
| 3-1 | 100 | 110 | 4.0 | — | — | — | — | — | — | — |
| 3-2 | | | 5.1 | — | — | — | — | — | — | — |
| 3-3 | | | 7.0 | — | — | — | — | — | — | — |
| 3-4 | | | — | 11.6 | — | — | — | — | — | — |
| 3-5 | | | — | — | 25.3 | — | — | — | — | — |
| 3-6 | | | — | — | — | 39.7 | — | — | — | — |
| 3-7 | | | — | — | — | — | 15.8 | — | — | — |
| 3-8 | | | — | — | — | — | — | 17.0 | — | — |
| 3-9 | | | — | — | — | — | — | — | 18.3 | — |
| 3-10 | | | — | — | — | — | — | — | — | 10.8 |
| 3-11 | | | — | — | — | — | — | — | — | — |
| 3-12 | | | — | — | — | — | — | — | — | — |
| 3-13 | | | — | — | — | — | — | — | — | — |
| 3-14 | | | 3.5 | 3.5 | — | — | — | — | — | — |
| 3-15 | | | — | — | — | — | 8.0 | — | 4.6 | — |
| 3-16 | | | — | — | — | — | — | — | — | 5.4 |
| 3-17 | | | — | — | — | — | — | — | — | — |

| Sample No. | Organic acid salt (g) on elementary metal basis | | | Mn nitrate (g) on elementary metal basis | $(M^{2+} + 1.5 \times M^{3+})/P$ | Coating tension (MPa) | Amount of dissolved phosphorus (μg/150 $cm^2$) | Corrosion resistance | Remark |
|---|---|---|---|---|---|---|---|---|---|
| | Ni malonate | Zn oxalate | Al oxalate | | | | | | |
| 3-1 | — | — | — | — | 0.65 | 6.0 | 350 | X | Comparative Example |
| 3-2 | — | — | — | — | 0.65 | 8.0 | 150 | ○ | Example |
| 3-3 | — | — | — | — | 0.75 | 8.5 | 120 | ○ | Example |
| 3-4 | — | — | — | — | | 9.2 | 100 | ◎ | Example |
| 3-5 | — | — | — | — | | 9.0 | 110 | ◎ | Example |
| 3-6 | — | — | — | — | | 9.5 | 60 | ◎ | Example |
| 3-7 | — | — | — | — | | 9.2 | 90 | ◎ | Example |
| 3-8 | — | — | — | — | | 9.0 | 100 | ◎ | Example |
| 3-9 | — | — | — | — | | 9.5 | 70 | ◎ | Example |
| 3-10 | — | — | — | — | | 9.5 | 70 | ◎ | Example |
| 3-11 | 16.9 | — | — | — | | 9.0 | 120 | ◎ | Example |
| 3-12 | — | 15.8 | — | — | | 9.2 | 100 | ◎ | Example |
| 3-13 | — | — | 5.2 | | | 8.3 | 100 | ○ | Example |
| 3-14 | — | — | — | — | | 8.5 | 110 | ○ | Example |
| 3-15 | 4.2 | — | — | — | | 9.1 | 100 | ◎ | Example |
| 3-16 | — | — | 2.6 | — | | 8.8 | 90 | ○ | Example |
| 3-17 | — | — | — | 15.8 | | 6.5 | 90 | X Occurrence of cracks and blisters | Comparative Example |

As shown in Table 3, when a treatment agent in which the amount of organic acid salt added was 5.0 parts by mass or more in terms of the metal element in the organic acid salt based on 100 parts by mass, on a solid basis, of a phosphate and in which orthophosphoric acid was added to adjust $(M^{2+}+1.5\times M^{3+})/P$ (molar ratio) to 0.65 or 0.75 was baked, an insulating coating having good corrosion resistance, a high coating tension, and high moisture absorption resistance was obtained. In particular, when a treatment agent containing an organic acid salt in an amount of 10 parts by mass or more in terms of the metal element in the organic acid salt was baked, an insulating coating whose tension imparted to the steel sheet was as high as 9.0 MPa or more was obtained. Furthermore, in particular, in the case of Nos. 3-6, 3-9, and 3-10 in which citrate, tartrate, or succinate in an amount of 10 parts by mass or more on an elemental metal basis was added to 100 parts by mass, on a solid basis, of the phosphate, an insulating coating whose tension imparted to the steel sheet was 9.5 MPa or more, whose amount of dissolved phosphorus was as low as 70 μg/150 $cm^2$ or less, and which had high corrosion resistance was obtained. In the case of No. 3-17 in which an inorganic acid salt was added, the insulating coating underwent cracking and blistering and had an insufficient coating tension and insufficient corrosion resistance.

Example 3

Treatment agents for chromium-free insulating coating formation each containing Mg phosphate, colloidal silica, and an organic acid salt shown in Table 4 and an aqueous orthophosphoric acid solution (specific gravity: 1.69) having a concentration of 85 mass % and each adjusted to a compositional ratio shown in Table 4 were produced (in sample No. 4-4, the aqueous orthophosphoric acid solution was not contained). The treatment agents were each applied to a final-annealed grain-oriented electrical steel sheet manufactured by a known method and having a forsterite coating and a thickness of 0.23 mm such that the total coating weight per unit area on both surfaces after drying would be 8 g/m$^2$, dried at 300° C. for one minute, and then subjected to a heat treatment (850° C., two minutes, 100 vol % $N_2$ atmosphere) for simultaneously achieving flattening annealing and baking of an insulating coating.

Samples of the insulation-coated grain-oriented electrical steel sheets thus obtained were evaluated for the tension imparted to the steel sheet (coating tension), moisture absorption resistance, and corrosion resistance by the above-described methods. For the imparted tension and the corrosion resistance, samples were collected, and then subjected to stress relief annealing (800° C., two hours) before being tested. The evaluation results are shown in Table 4.

TABLE 4

| Sample No. | Mg phosphate (g) (on solid basis) | Colloidal silica (g) (on $SiO_2$ solid basis) | Mg citrate (g) (on Mg basis) | Fe citrate (g) (on Fe basis) | Addition of phosphoric acid | pH of treatment agent | $(M^{2+} + 1.5 \times M^{3+})/P$ | Coating tension (MPa) | Amount of dissolved phosphorus (μg/150 cm$^2$) | Corrosion resistance | Remark |
|---|---|---|---|---|---|---|---|---|---|---|---|
| 4-1 | 100 | 110 | 7.0 | — | yes | 2.7 | 0.50 | 4.0 | 550 | X | Comparative Example |
| 4-2 | | | 7.0 | — | yes | 3.0 | 0.55 | 8.0 | 180 | ○ | Example |
| 4-3 | | | 7.0 | — | yes | 3.0 | 0.67 | 9.2 | 110 | ○ | Example |
| 4-4 | | | 7.0 | — | no | 4.7 | 0.80 | 6.0 | 300 | X | Comparative Example |
| 4-5 | | | 9.5 | — | yes | 2.9 | 0.80 | 9.2 | 60 | ◎ | Example |
| 4-6 | | | 9.5 | — | yes | 2.8 | 0.83 | 9.4 | 70 | ◎ | Example |
| 4-7 | | | 2.4 | 10.9 | yes | 2.8 | 0.83 | 9.5 | 50 | ◎ | Example |
| 4-8 | | | 9.5 | — | yes | 2.8 | 0.90 | 8.5 | 70 | ◎ | Example |
| 4-9 | | | 28.0 | — | yes | 4.7 | 1.20 | 4.0 | 600 | X | Comparative Example |

As shown in Table 4, when a treatment agent containing an organic acid salt in an amount of 5.0 parts by mass or more on an elemental metal basis based on 100 parts by mass, on a solid basis, of a phosphate and containing orthophosphoric acid in such an amount that the molar ratio between the metal element and the phosphorus element in the treatment agent satisfied $0.50<(M^{2+}+1.5\times M^{3+})/P\leq 1.20$ and pH<4.5 was satisfied was baked, an insulating coating having good corrosion resistance, a high coating tension, and high moisture absorption resistance was obtained. In particular, when the organic acid salt and orthophosphoric acid were contained in such an amount that $0.67\leq(M^{2+}+1.5\times M^{3+})/P\leq 0.83$ and pH<4.5 were satisfied, the tension imparted to the steel sheet was as high as 9.0 MPa or more.

Example 4

Treatment agents for chromium-free insulating coating formation each containing Mg phosphate, colloidal silica, and an organic acid salt (Mg citrate) shown in Table 5 and an aqueous orthophosphoric acid solution (specific gravity: 1.69) having a concentration of 85 mass % and each adjusted to a pH of less than 4.5 and a compositional ratio shown in Table 5 were produced. The treatment agents were each applied to a final-annealed grain-oriented electrical steel sheet manufactured by a known method and having a forsterite coating and a thickness of 0.23 mm such that the total coating weight per unit area on both surfaces after drying would be 8 g/m$^2$, dried at 300° C. for one minute, and then subjected to a heat treatment (850° C., two minutes, 100 vol % $N_2$ atmosphere) for simultaneously achieving flattening annealing and baking of an insulating coating.

Samples of the insulation-coated grain-oriented electrical steel sheets thus obtained were evaluated for the tension imparted to the steel sheet (coating tension), moisture absorption resistance, corrosion resistance, and the carbon content in a coating were evaluated by the above-described methods (the carbon content in a coating was evaluated by a method in accordance with JIS G 1211-3). For the imparted tension and the corrosion resistance, samples were collected, and then subjected to stress relief annealing (800° C., two hours) before being tested. The evaluation results are shown in Table 5.

TABLE 5

| Sample No. | Mg phosphate (g) (on solid basis) | Colloidal silica (g) (on $SiO_2$ solid basis) | Mg citrate (g) (on Mg basis) | Specific gravity | $(M^{2+} + 1.5 \times M^{3+})/P$ | Carbon content in coating (mass %) | Coating tension (MPa) | Amount of dissolved phosphorus (μg/150 cm$^2$) | Corrosion resistance | Remark |
|---|---|---|---|---|---|---|---|---|---|---|
| 5-1 | 100 | 110 | 9.0 | 1.05 | 0.75 | 0.048 | 9.3 | 90 | ○ | Example |
| 5-2 | | | | 1.07 | | 0.050 | 9.5 | 70 | ◎ | Example |
| 5-3 | | | | 1.15 | | 0.102 | 9.4 | 70 | ◎ | Example |
| 5-4 | | | | 1.15 | | 0.103 | 9.3 | 70 | ◎ | Example |
| 5-5 | | | | 1.15 | | 0.102 | 9.3 | 70 | ◎ | Example |
| 5-6 | | | | 1.30 | | 0.226 | 9.6 | 60 | ◎ | Example |
| 5-7 | | | | 1.35 | | 0.350 | 9.5 | 50 | ◎ | Example |
| 5-8 | | | | 1.37 | | 0.356 | 8.7 | 50 | ◎ | Example |

As shown in Table 5, when a treatment agent in which the amount of organic acid salt added was 5.0 parts by mass or more in terms of the metal element in the organic acid salt based on 100 parts by mass, on a solid basis, of a phosphate and in which orthophosphoric acid was added to adjust $(M^{2+}+1.5\times M^{3+})/P$ (molar ratio) to 0.75 was baked, an insulating coating having good corrosion resistance, a high coating tension, and high moisture absorption resistance was obtained. In particular, when the carbon content in a coating was 0.050 to 0.350 mass %, the amount of dissolved phosphorus was as low as 70 μg/150 $cm^2$ or less, high corrosion resistance was exhibited, and the tension imparted to the steel sheet was as high as 9.0 MPa or more. As shown in Table 5 and FIG. 1, the carbon contents in coatings including insulating coatings formed using the treatment agents for chromium-free insulating coating formation of Nos. 5-2 to 5-7 having specific gravities of 1.07 to 1.35 were 0.050 to 0.350 mass %.

The invention claimed is:

1. A treatment agent for chromium-free insulating coating formation suitable for forming an insulating coating on a surface of a grain-oriented electrical steel sheet, the treatment agent comprising:

a component (A): at least one selected from the group consisting of phosphates of Mg, Ca, Ba, Sr, Zn, Al, and Mn;

a component (B): colloidal silica;

a component (C): at least one selected from the group consisting of organic acid salts of Mg, Ca, Ba, Sr, Zn, Al, Mn, Fe, Ni, Cu, and Co; and a component (D): phosphoric acid, wherein the component (B) is contained in an amount in a range of 50 to 150 parts by mass on a $SiO_2$ solid basis, and the component (C) is contained in an amount of 5.0 parts by mass or more on an elemental metal basis, the amounts being based on 100 parts by mass, on a solid basis, of the component (A), the component (D) is contained in excess of a molar ratio of phosphoric acid and metal of the phosphate derived from the component (A), and in an amount that a molar ratio of $M^{2+}$ and $M^{3+}$, each being a metal element in the treatment agent for chromium-free insulating coating formation, to a phosphorus element P satisfies:

$$0.50<(M^{2+}+1.5\times M^{3+})/P\leq 1.20$$

where $M^{2+}$ is at least one selected from the group consisting of Mg, Ca, Ba, Sr, Zn, Mn, Ni, Cu, and Co, and $M^{3+}$ is at least one selected from the group consisting of Al and Fe, the treatment agent for chromium-free insulating coating formation has a pH of less than 4.5.

2. The treatment agent for chromium-free insulating coating formation according to claim 1, wherein the component (C) includes at least one selected from the group consisting of carboxylates of Mg, Ca, Ba, Sr, Zn, Al, Mn, Fe, Ni, Cu, and Co.

3. The treatment agent for chromium-free insulating coating formation according to claim 1, wherein the component (C) includes at least one selected from the group consisting of formates, oxalates, citrates, tartrates, lactates, malonates, succinates, salicylates, acetates, and gluconates of Mg, Ca, Ba, Sr, Zn, Al, Mn, Fe, Ni, Cu, and Co.

4. The treatment agent for chromium-free insulating coating formation according to claim 1, wherein the treatment agent has a specific gravity in a range of 1.07 to 1.35.

5. An insulation-coated grain-oriented electrical steel sheet comprising:

a grain-oriented electrical steel sheet; and an insulating coating formed by baking the treatment agent for chromium-free insulating coating formation according to claim 1, wherein the insulating coating is disposed on a surface of the grain-oriented electrical steel sheet.

6. The insulation-coated grain-oriented electrical steel sheet according to claim 5, wherein a carbon content in a coating including the insulating coating is in a range of 0.050 to 0.350 mass %.

7. A method for manufacturing an insulation-coated grain-oriented electrical steel sheet, comprising:

applying the treatment agent for chromium-free insulating coating formation according to claim 1 to a surface of a grain-oriented electrical steel sheet; and baking the treatment agent.

8. The treatment agent for chromium-free insulating coating formation according to claim 2, wherein the component (C) includes at least one selected from the group consisting of formates, oxalates, citrates, tartrates, lactates, malonates, succinates, salicylates, acetates, and gluconates of Mg, Ca, Ba, Sr, Zn, Al, Mn, Fe, Ni, Cu, and Co.

9. The treatment agent for chromium-free insulating coating formation according to claim 2, wherein the treatment agent has a specific gravity in a range of 1.07 to 1.35.

10. The treatment agent for chromium-free insulating coating formation according to claim 3, wherein the treatment agent has a specific gravity in a range of 1.07 to 1.35.

11. The treatment agent for chromium-free insulating coating formation according to claim 8, wherein the treatment agent has a specific gravity in a range of 1.07 to 1.35.

12. An insulation-coated grain-oriented electrical steel sheet comprising:

a grain-oriented electrical steel sheet; and an insulating coating formed by baking the treatment agent for chromium-free insulating coating formation according to claim 2, wherein the insulating coating is disposed on a surface of the grain-oriented electrical steel sheet.

13. An insulation-coated grain-oriented electrical steel sheet comprising:

a grain-oriented electrical steel sheet; and an insulating coating formed by baking the treatment agent for chromium-free insulating coating formation according to claim 3, wherein the insulating coating is disposed on a surface of the grain-oriented electrical steel sheet.

14. An insulation-coated grain-oriented electrical steel sheet comprising:

a grain-oriented electrical steel sheet; and an insulating coating formed by baking the treatment agent for chromium-free insulating coating formation according to claim 8, wherein the insulating coating is disposed on a surface of the grain-oriented electrical steel sheet.

15. The insulation-coated grain-oriented electrical steel sheet according to claim 12, wherein a carbon content in a coating including the insulating coating is in a range of 0.050 to 0.350 mass %.

16. The insulation-coated grain-oriented electrical steel sheet according to claim 13, wherein a carbon content in a coating including the insulating coating is in a range of 0.050 to 0.350 mass %.

17. The insulation-coated grain-oriented electrical steel sheet according to claim 14, wherein a carbon content in a coating including the insulating coating is in a range of 0.050 to 0.350 mass %.

18. A method for manufacturing an insulation-coated grain-oriented electrical steel sheet, comprising:

applying the treatment agent for chromium-free insulating coating formation according to claim 2 to a surface of a grain-oriented electrical steel sheet; and baking the treatment agent.

19. A method for manufacturing an insulation-coated grain-oriented electrical steel sheet, comprising:

applying the treatment agent for chromium-free insulating coating formation according to claim 3 to a surface of a grain-oriented electrical steel sheet; and baking the treatment agent.

20. A method for manufacturing an insulation-coated grain-oriented electrical steel sheet, comprising:

applying the treatment agent for chromium-free insulating coating formation according to claim 8 to a surface of a grain-oriented electrical steel sheet; and baking the treatment agent.

* * * * *